United States Patent [19]

Young

[11] Patent Number: 4,722,161

[45] Date of Patent: Feb. 2, 1988

[54] MODULAR WOOD CEILING SYSTEM

[76] Inventor: Lester Young, 4800 Corbin Ave., Tarzana, Calif. 91356

[21] Appl. No.: 374,547

[22] Filed: Apr. 29, 1982

Related U.S. Application Data

[63] Continuation of Ser. No. 118,732, Feb. 5, 1980, abandoned.

[51] Int. Cl.[4] ..... E04B 5/52

[52] U.S. Cl. ..... 52/484; 52/745

[58] Field of Search ..... 52/316, 456, 732, 813, 52/484, 745; 40/152; 428/14

[56] References Cited

U.S. PATENT DOCUMENTS

| | | | |
|---|---|---|---|
| 749,118 | 1/1904 | Walbridge | 52/656 |
| 1,500,025 | 7/1924 | Mayer | 40/152 |
| 3,319,389 | 5/1967 | Levine | 52/732 |
| 3,886,677 | 6/1975 | Behring et al. | 428/14 |
| 4,189,888 | 2/1980 | Blitzer | 52/316 |

FOREIGN PATENT DOCUMENTS

| | | | |
|---|---|---|---|
| 417420 | 6/1924 | Fed. Rep. of Germany | 52/813 |
| 15979 | 1/1898 | Switzerland | 52/456 |
| 25462 | of 1912 | United Kingdom | 52/456 |

*Primary Examiner*—James L. Ridgill, Jr.
*Attorney, Agent, or Firm*—David S. Romney

[57] ABSTRACT

Disclosed is a ceiling system intended to give the appearance, warmth, beauty and elegance of a custom-made, handcrafted coffered wood-paneled ceiling, while at the same time having the convenient erection capability and convenient access for repair purposes of a conventional suspended ceiling. Prior art main-T's and cross-T's may have their horizontal lower portions positioned inside suitably dimensioned key-shaped slots provided in wood trim strips so that when the cross-T's and main-T's are assembled to one another, only wood components and not bare or painted metal is visible from below. Furthermore, the conventional suspended ceiling panel of the prior art is replaced by a wooden ceiling panel with a rectangular sheet having wood veneer covering its exposed lower surface and having at its four outer edges hardwood moulding depending therefrom.

7 Claims, 5 Drawing Figures

MODULAR WOOD CEILING SYSTEM

This application is a continuation of application Ser. No. 118,732, filed Feb. 5, 1980 now abandoned.

FIELD OF THE INVENTION

This invention relates generally to building materials and methods of construction and, in particular, to a novel type of ceiling and a method for fabricating and erecting such a ceiling.

BACKGROUND OF THE INVENTION

A. Prior Art

Suspending ceiling systems are well known in the building construction arts as a convenient solution to the problem of providing a ceiling at a given height above the floor without requiring a carefully laid-out system of girders and joists. Such a ceiling can be suspended at the desired height by wires from combination hook and nail devices driven into the existing ceiling or any conveniently located existing overhead structure. Components for such prior art modular suspended ceiling systems are illustrated, for example, on page 1012 of the Sears, Roebuck and Co, Fall and Winter 1979 catalogue.

In these conventional suspended ceiling systems, there is provided a horizontal assembly of regularly spaced grid work comprising main T's, cross T's and (optionally) wall angles, all conveniently fabricated from metal.

Modular panels (which may be, for example, acoustical wood-fiber panels, or panels of fire-retardant insulative materials such as Fiberglass, or clear acrylic prismatic diffuser panels) are dimensioned to fit inside the openings of the grid work and are held in place by the horizontally projecting lower edges of said cross T's, main T's and wall angles. The standard modular dimensions for such prior art systems are 2'×2' and 2'×4'.

Such prior art systems, although easily erected, have a rather unattractive appearance resulting from the mass-produced functionality of the exposed grid work and the barren regularity of the associated plastic (or other synthetic material) panels.

On the other hand, ceilings are also known in the prior art wherein sheets of plywood or other natural material are nailed to conventional ceiling girders and joists, with wooden moulding strips being employed to hide the joints between said panels. Such a ceiling, while giving its room the "warmth" that can be obtained only by the use of natural materials requires that each panel and moulding strip b individually fitted and secured in place by a skilled carpenter. Furthermore, individual panels cannot be readily removed to permit access to space thereabove and accordingly, any electrical conduits, lighting fixtures, air ducts or other equipment contained in said space cannot be readily accessed for repairs or improvements.

B. Brief Description

Briefly, in accordance with the teachings of my invention, I have improved and modified the suspended ceiling support main and cross-T's of the prior art by including their horizontal lower portion inside a suitably dimensioned key-shaped slot in wood trim strips, providing notches upwardly at appropriated intervals in the upper surface of those wood strips that are associated with the main-T's and making the wood strips of the cross-T's somewhat shorter than the cross-T's themselves, thereby allowing the cross-T's and main-T's to be assembled leaving only wood and not bare or painted metal visible from below.

Furthermore, in accordance with other teachings of my invention, instead of the conventional acoustical wood fiber panels or insulated fiberglass panels or prismatic acrylic plastic panels of the prior art, I employ a novel wooden ceiling panel with a rectangular sheet having wood veneer covering its exposed lower surface and having at its four outer edges hardwood moulding depending therefrom, said hardwood moulding being fastened to each other and to the flat panel to provide a recessed three-dimensional effect, especially in combination with the wood strips of the grid system, said wooden strips obscuring any imperfections in the fit of the individual panels or deviations from precise 90° angles where the main-T's and cross-T's join one another and at the same time obscuring any visible fastening means that was used to join the mouldings to one another or to the horizontal panels.

Thus I have a ceiling having all of the appearance, warmth, beauty and elegance of a custom-made, handcrafted, wood-paneled ceiling, while at the same time having the convenient erection capability and convenient access for repair purposes of a conventional suspended ceiling.

DETAILED DESCRIPTION OF A PREFERRED EMBODIMENT

Figure 1:
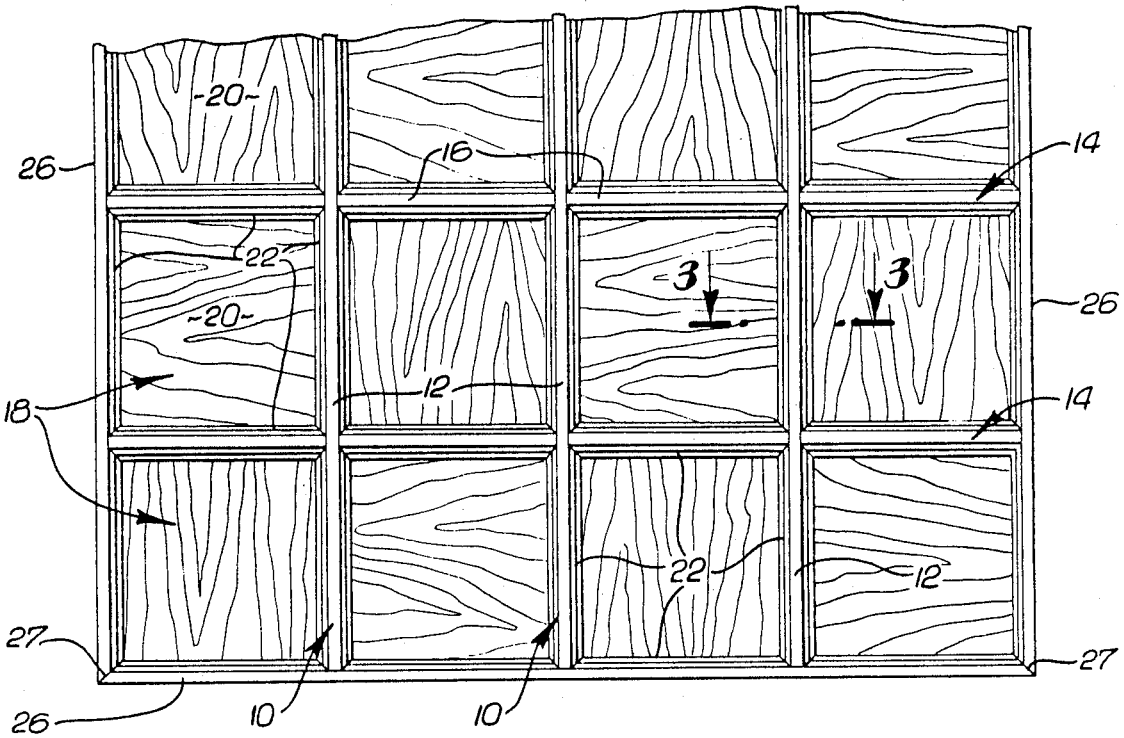
FIG. 1 shows the modular ceiling of the present invention as it is seen from the interior of the room over which it is suspended.

Referring now with particularity to FIG. 1 in which is shown in plan view the modular ceiling system of the present invention as it is seen suspended above the interior of a room, it may be seen that the system comprises a plurality of main-T's 10 of which, when so suspended and in place, only an elongate hardwood main-T trim strip 12 of generally horizontal cross-section is actually visible, said main-T's being suspended parallel to one another and connected to each other by means of cross-T's 14 oriented perpendicular thereto.

As was true in the case of the main-T's, the whole of the cross-T is not visible from the interior of the room when the ceiling is suspended and in place, but rather only an elongate hardwood cross-T trim strip 16 (also of generally horizontal cross-section).

In a preferred embodiment, the standard modular dimension is two foot by two foot. Accordingly, both the main-T's and the cross-T's are normally laid out on approximate 24 inch center to center intervals. The nominal dimension of the main-T and cross-T trim strips is $1\frac{3}{8}$ inch wide and, in the case of the cross-T trim strips, $2\frac{1}{2}$ inches long. Although the thickness dimension of the main-T and cross-T hardwood trim strips is not visible in FIG. 1, (it is visible in FIGS. 2 and 3) it may be noted at this point that the nominal thickness dimension is 7/16 of an inch. From the Figure, it can be seen that the nominal length of one of the cross-T trim strips is the nominal modular center to center dimension (hereinafter referred to as the "first spacing") of the main-T's minus the nominal width of the main-T trim strip minus an additional amount (approximately one eighth of an inch) to provide a small clearance to allow for deviations in manufacture and installation from the nominal modular 24 inch center to center spacings.

At this point it can also be noted that the main-T trim strips are ib length not a fractional part of the nominal modular center to center spacing but rather run in integral multiples thereof or perhaps the entire length of the room, as the case may be.

Figure 3:
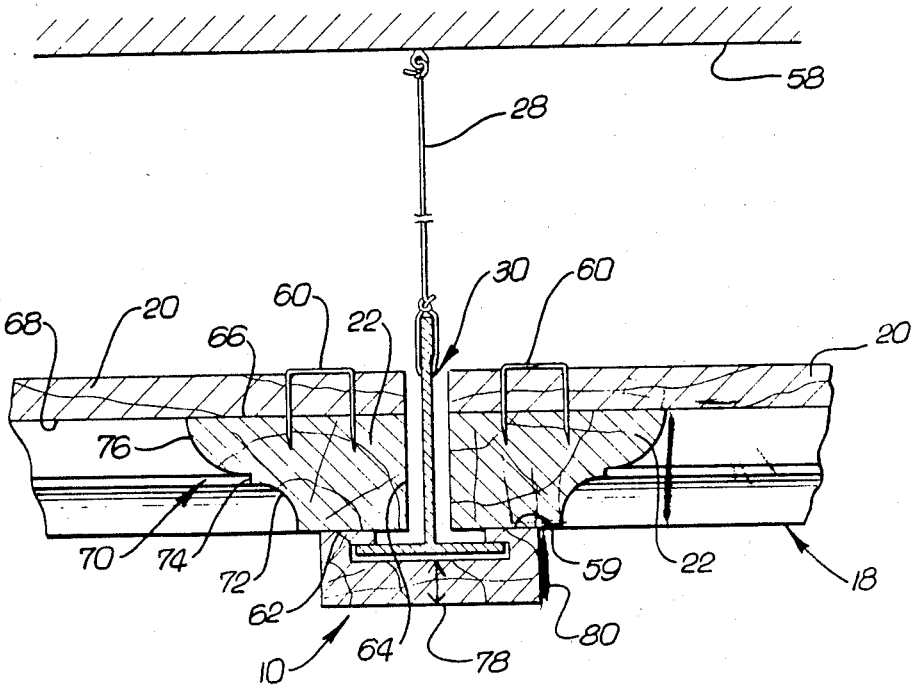
FIG. 3 shows, in cross section, a main-T of the present invention suspended from a supporting structure and in turn supporting the frame and sheet members of adjacent drop-in modules.

Also, as is better visible in FIG. 3, there is provided a plurality of suspended ceiling panels, one of which is indicated by the reference numeral 18, each comprising a sheet member 20 and four hardwood frame mouldings 22. As shown in the drawing of FIG. 1, each panel sheet member 20 has a hardwood veneer grain pattern visible from the interior of the room and the direction of the grain may alternate from panel to adjacent panel, thereby providing an exceedingly attractive parquet effect.

Figure 1A:
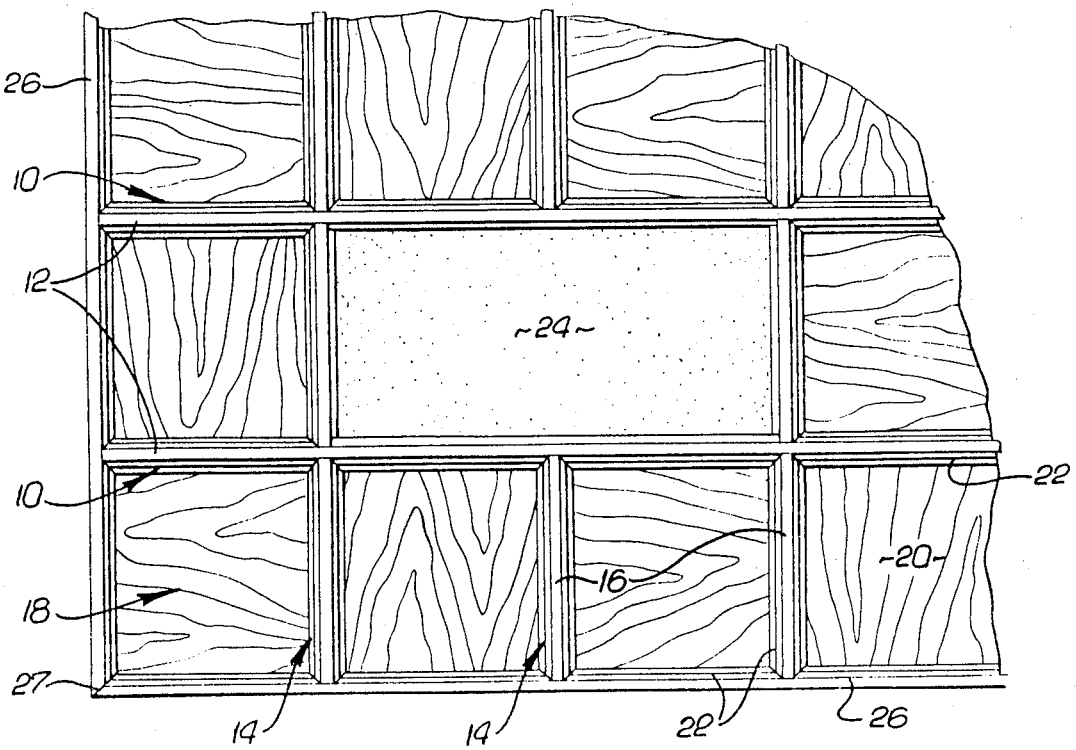
FIG. 1*a* is a variant thereof.

Although the above description has assumed a square module of two foot by two foot, it is clear that the present invention can also be adapted for other modular dimensions including a two foot by four foot modular system for which conventional suspended heat panels and light fixtures are already available, or (as shown in FIG. 1*a*) conventional rectangular two by four foot recessed fluorescent fixtures, such as that shown at reference numeral 24, may be combined with square two foot by two foot ceiling modules.

In FIG. 1, there is also visible at the edges of the room wall angle trim strips 26, which may be conveniently joined to one another with a miter-joint shown diagramatically at 27; the purpose of such wall angle trim strips is to give a finished appearance to the entire ceiling structure.

Figure 2:
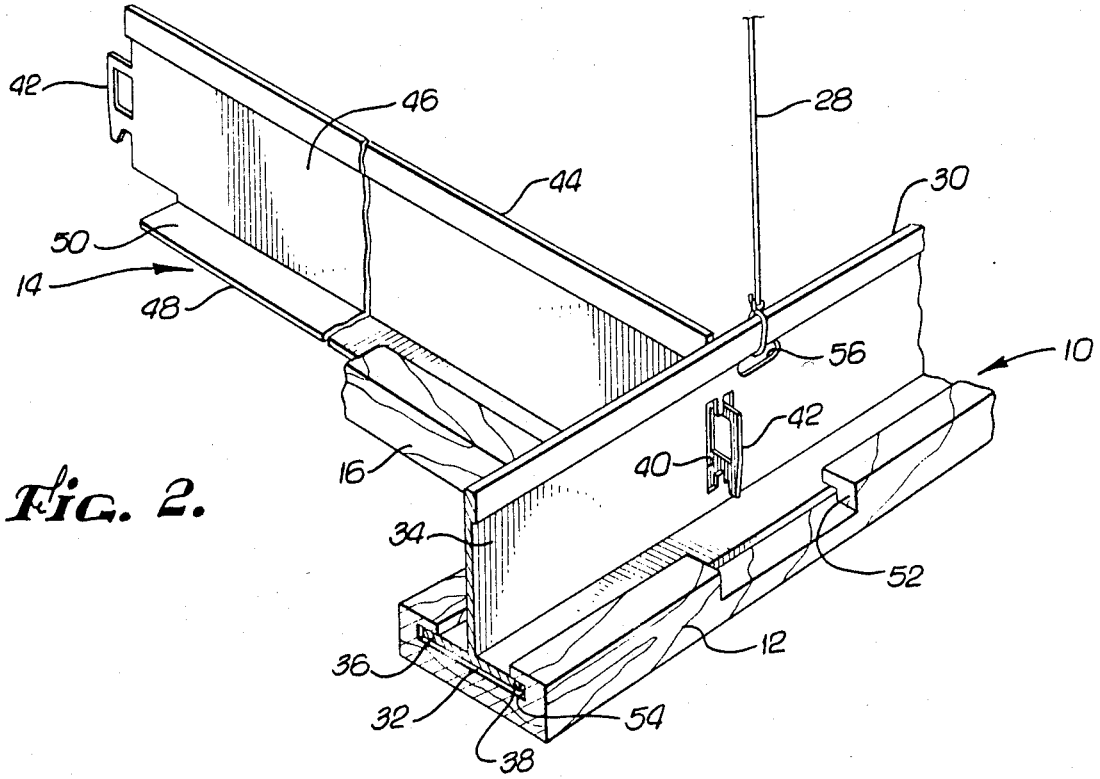
FIG. 2 is an isometric view showing how the cross-T's and main-T's of the present invention may be connected to each other and the whole assembly suspended by a wire.

Referring now with greater particularlity to FIG. 2, which shows one of the main-T's 10 of FIG. 1 suspended by a wire 28 and an assembled cross-T 14 connected thereto, it may be seen that each main-T 10 comprises, in addition to the main-T trim strip elongate wooden hardwood strip 12, a metal bar 30 of generally inverted T cross-section and having a generally horizontal lower portion 32 and a generally vertical upper portion 34 attached to said horizontal lower portion and extending upwardly therefrom such that the lower portion is divided into approximately equal right and left half portions (36 and 38 respectively) by said generally vertical upper portion. Also visible in FIG. 2 is an aperture 40 in metal bar 30 through which a cross-T prong 42 may be inserted—one from the left as shhown, and a second from the right, not shown.

Since in the preferred embodiment described, the cross-T's 14 are to be installed at approximately regular 24 inch center to center spacing intervals, clearly cross-T prong apertures 40 are also provided at such 24 inch intervals throughout the length of main-T bar upper portion 34. Hereinafter, the spacing between adjacent ones of said apertures will be referred to as the "second spacing" and the nominal center to center distance between parallel and adjacent cross-T's will be an integral multiple of said second spacing distance.

As was the case of main-T member 10, cross-T member 14 also comprises in addition to the elongate hardwood trim strip 16 an elongate metal bar of genrally inverted T-cross section indicated by the reference numeral 44 which, as was also the case of the main-T bar, comprises a vertical upper portion 46 and a horizontal lower portion 48 comprised of a right half 50 and (not visible in the drawing) a left half similar to that of the main-T bar left hand portion 36. As is apparent from the Figures, the length of cross-T bar horizontal lower portion right half 50 (and also of the left half not shown) is somewhat less than the nominal 24 inch center to center line spacing.

On the other hand, the length of the horizontal upper portion 46 of cross-T bar 44 is somewhat longer than the nominal center to center spacing. In order to provide structural connections between the cross-T's and the main-T's, it is necessary for the prongs of the cross-T's to actually protrude through the apertures provided in the main-T; however, the lower horizontal lower portion of the cross-T's must not interfere with the lower horizontal portion of the main-T's and the main-T bars.

FIG. 2 also shows a notch 52 provided in main-T trim strip 12 in the vicinity of aperture 40 to provide clearance of the metal cross-T bar, although it is to be noted that the wooden trim strip 16 associated with the cross-T does not extend into the main-T trim strip.

Also clearly apparent from FIG. 2 is the manner in which the main-T bar 30 is slid into a longitudinally extending upwardly open keyway 54 provided as part of main-T trim strip 12, the dimensions of keyway 54 being such that the right and left halfs 36 and 38 of main-T bar horizontal portion 32 may be snugly accepted therein.

In much the same manner, lower horizontal portion 48 of cross-T bar 44 is also accomodated within a longitudinally extending upwardly open keyway (not visible in the Figures) provided as part of cross-T trim strip 16, but otherwise identical in shape and function to main-T keyway 54.

As can be seen most clearly in FIG. 2, main-T bar 30 may be provided with suitably located suspension apertures 56 through which suspension wires 28 may be inserted and secured by twisting.

Referring now to FIG. 3, which shows in cross-section main-T bar 30 secured in place, partly within and partly protruding from keyway 54 of main-T trim strip 12, and in turn suspended by means of suspension wire 28 from a suitable suspension structure 58, it may be seen that the upper surface 59 of trim strip 12 may support the frame moulding pieces 22 of the modular panel 18, said frame moulding being attached to the sheet 20 by means of, for instance, a staple 60. It may also be seen in the cross-section view of FIG. 3 (which is of a larger scale than the plan view of FIG. 1 and, accordingly, the detail is much more apparent) that each frame moulding piece 22 comprises a horizontal lower surface 62, a vertical outer edge 64 (which when in place is slightly spaced away from the vertical T-bar portions 34 and 46), a horizontal upper surface 66 (which contacts with the lower surface 68 of sheet 20) and a decoratively shaped upwardly and inwardly extending surface 70 comprisig a lower, concave portion 72, an intermediate straight portion 74, and an upper convex portion 76.

As a result of the sizes and shapes of the individual components and the manner in which they are to be positioned with respect to one another, when the ceiling is installed and suspended in place, the only portions of the ceiling system components visible to the occupants of the room are the lower horizontal and vertical longitudinal surfaces 78 and 80, respectively, of main-T and cross-T trim strip 12 and 16, a portion of hardwood frame moulding lower surface 62, the upwardly and inwardly extending decoratively routed frame moulding surface 70, and lower surface 68 of sheet member 20 (which, as has been mentioned previously, is provided with a suitable hardwood grain pattern by means of veneer or the like).

Main-T bar member 30 and cross-T bar member 44 have not been described in any great detail, the present invention being intended for use with conventional commercially available cross-T and main-T gridwork constructed of aluminum or other appropriate strong but light material and already extruded into the desired cross-section and already provided with the required apertures and prongs.

Figure 4:
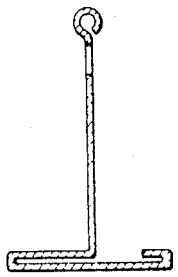
FIG. 4 shows, in cross section, an alternate type of metal T-bar useable with the present invention.

FIG. 4 shows another type of commercially available gridwork employing not extruded T-shape members, but rather T-shape members formed of a single sheet of metal by means of appropriate bending and crimping operations.

The pre-assembly of the drop-in panels of the presently preferred embodiment of the invention can be done ahead of time away from the job site, if desired. According to a presently preferred method of the invention, the initial steps include cutting a plurality of sheets of ceiling material to predetermined length and predetermined width dimensions. Moulding pieces are also cut to the same length and width dimensions as the sheets. Two of the matching length molding pieces are held in oppositely spaced apart positions, and two of the matching width molding pieces are also held in oppositely spaced apart positions, together forming a frame-like co-planar composite structure approximating their positions in the completed drop in panel, by use of a jig or other conventional positioning device. One of the cut sheets of ceiling material is placed on top of and parallel to the four molding pieces held in the jig, and then fastened by staples or other suitable fastener driven through the sheet material into the molding pieces. An optional step includes driving a reinforcing fastener across a junction between a width molding piece and a length molding piece.

The installation of the ceiling of the present invention at the job site is accomplished in the following preferred steps. The wall angle bars (if utilized) are affixed to the appropriate position around the periphery of the room by nailing to the wall or other suitable fastener means. A suitable hardwood trim strip facing may then be affixed to the wall angles to cover the nail heads and exposed surfaces of the angle bars. The main T-bars and cross T-bars are matched with and attached to their respective hardwood trim strips, and the resulting cross-T and main-T pieces are then lifted individually for attachment to their respective hangers suspended from the upper ceiling structure, with the abutting junctions between intersecting main T-bars and cross T-bars joined together in notched-fashion as shown in the drawing. The individual drop-in panels are then lifted up from the floor through their respective apertures in the overhead grid formed by the wall angles, main-T's and cross-T's and turned into their at rest position against the top surfaces of the trim strips.

The aforementioned method of the present invention enables the pre-assembly of the unique drop-in panels in accordance with predetermined dimensional specifications without the need of high-paid wood craftsmen, while maintaining sufficient quality control to meet the aesthetic standards for the traditional coffered ceiling. Also, the assembly and installation at the job site can be accomplished efficiently with minimum supervision, producing a completed ceiling having a facade of beautiful hardwood panels and moulding without exposing any of the fasteners or underlying metal support structure of the T-bars.

Although the invention has been described in detail with respect to a particular preferred embodiment with only a few variations being discussed in connection therewith, it is clear that other variations will be obvious to one skilled in the art without departing from the spirit of the invention. Accordingly, the scope of the invention is not intended to be limited by specific details of the preferred embodiment described above, but only by the claims appended hereto.

What is claimed is:

1. A ceiling system adapted to be suspended above the interior of a room, said system comprising in combination:

a plurality of cross-T's, each of said cross-T's comprising:

an elongate cross-T bar of generally inverted-T cross section and having a generally horizontal lower portion and a generally vertical upper portion attached to said horizontal lower portion and extending upwardly therefrom, said cross-T bar lower portion having a length less than a first spacing distance, said cross-T bar lower portion furthermore being of relatively constant width and thickness and being divided into approximately equal right and left halves by said generally vertical upper portion, said cross-T bar upper portion having at each end a prong protruding in the lengthwise direction beyond said generally horizontal lower portion; and an elongate hardwood cross-T trim strip of generally horizontal cross section, said cross-T strip having a first longitudinally extending upwardly open keyway provided therein dimensioned in depth and width to accept said cross-T horizontal lower portion therein, and said cross-T strip having a length approximately equal to said first spacing distance minus the width dimension of a typical main-T trim strip;

a plurality of main-T's, each of said main-T's comprising:

an elongate main-T bar of generally inverted-T cross section and having a generally horizontal lower portion and a generally vertical upper portion attached to said horizontal lower portion and extending upwardly therefrom, said main-T bar lower portion being of relatively constant width and thickness and being divided into approximate equal right and left halves by said generally vertical upper portion, said main-T bar upper portion having at regularly spaced second spacing intervals along its length a plurality of apertures through which cross-T prongs may be inserted; and an elongate hardwood main-T trim strip of generally horizontal cross-section, said main-T strip having a longitudinally extending upwardly open keyway provided therein, dimensioned in depth and width to accept said main-T horizontal lower portion therein, said main-T's and cross-T's being adapted to form, when assembled to one another and when suspended from suitable structure thereabove with said main-T's oriented approximately perpendicularly to said cross-T's, a generally rectangular open work grid of generally horizontal extend and having approximately said first spacing between the centers of adjacent ones of said main-T's and approximately an integral multiple of said second spacing between the centers of adjacent ones of said cross-T's; and a plurality of drop-in modules adapted to be held in the respective grid openings by the respective upper edges of said cross-T and main-T trim strips, each of said modules comprising:

a rectangular, generally horizontally extending sheet having a width dimension less than said first spacing and a length dimension less than an integral multiple of said second spacing, and furthermore having an upper surface and a lower surface, at least said lower surface being provided with a hardwood veneer grain pattern; and a generally rectangular hardwood frame having width and length dimensions approximately equal to the corresponding dimensions of the corresponding said sheet, said frame comprising four pieces of hardwood moulding each of similar cross-section and having mitered ends, and said frame being fastened to said sheet, whereby when said ceiling system is assembled and in place, only said hardwood trim strips, said hardwood frame mouldings, and said hardwood veneer grained sheet components of said ceiling system are visible from the interior of the room.

2. The suspended ceiling system of claim 1 wherein said frame is fastened to said sheet by means of a plurality of staples protruding downwardly from said sheet into said frame.

3. The ceiling system of claim 1 wherein said each main-T trim strip has a plurality of upwardly extending notches spaced along its length at intervals approximately equal to said second spacing interval for accommodating the respective part of said cross-T bar lower portion.

4. The ceiling system of claim 1 wherein said frame hardwood moulding cross-section comprises:

a horizontal lower surface;

a vertical outer edge;

a horizontal upper surface; and a decoratively shaped surface extending upwardly and inwardly from said horizontal lower surface to said horizontal upper surface.

5. The ceiling system of claim 4 wherein said decoratively shaped surface comprises:

a lower concave portion;

an intermediate straight portion; and an upper convex portion.

6. A method for fabricating and installing a ceiling system comprising the steps of:

a. cutting a plurality of sheets of ceiling material to predetermined modular length and width dimensions;

b. cutting two molding pieces for each of the sheets cut in step a. to said modular width dimension;

c. cutting two molding pieces for each of the sheets cut in step a. to said modular length dimension;

d. holding two of said cut-to-length molding pieces and two of said cut-to-width molding pieces in a fixed frame-like co-planar position relative to one another approximating their respective position to each other in the assembled drop in panel;

e. placing one of said cut sheets of ceiling material on top of and parallel to the four pieces of molding while they are still being held in said frame-like position;

f. fastening the sheet of cut material to the four hardwood molding pieces held thereunder by means of fasteners driven through said sheet material into respective ones of said molding pieces;

g. repeating steps d., e., and f. until the required number of drop in modular panels have been prefabricated;

h. assembling a plurality of main-T's by inserting a plurality of main-T's by inserting a plurality of main-T bars into the respective key-ways provided in a corresponding plurality of main-T trim strips;

i. assembling a plurality of cross-T's by inserting a plurality of cross-T bars into the respective key-ways provided in a corresponding plurality of cross-T trim strips;

j. suspending a plurality of hangers from an upper support structure;

k. suspending said main T's by attaching them to their respective hangers;

l. suspending said cross-T's by inserting their prones into the respective prong apertures provided in said main-T's;

m. lifting each previously prefabricated drop in modular panel through a corresponding aperture in the gridwork formed by the suspended main-T's and cross-T's; and n. positioning each said panel such that its four lower edges rest against the respective upper edges of said main-T and cross-T trim strips.

7. The method of claim 6 wherein said fastening step further includes driving a reinforcing fastener across a junction between a width molding piece and a length molding piece.

* * * * *